United States Patent [19]

Michel

[11] 4,344,646

[45] Aug. 17, 1982

[54] DETACHABLE LATCH

[75] Inventor: John M. Michel, Coatesville, Pa.

[73] Assignee: Woodstream Corporation, Lititz, Pa.

[21] Appl. No.: 153,562

[22] Filed: May 27, 1980

[51] Int. Cl.[3] ..... E05C 19/06

[52] U.S. Cl. ..... 292/87; 292/DIG. 38

[58] Field of Search ..... 292/DIG. 30, 80, 87, 292/88, 89, 19, 20, DIG. 38

[56] References Cited

U.S. PATENT DOCUMENTS

| | | | |
|---|---|---|---|
| 3,410,391 | 11/1968 | Kanter | 206/1.5 |
| 3,429,603 | 2/1969 | Gejoff | 292/80 |
| 3,544,146 | 12/1970 | Asenbauer | 292/87 |
| 3,730,576 | 5/1973 | Schurman | 292/246 |
| 3,822,905 | 7/1974 | Bell | 292/87 |
| 4,223,787 | 9/1980 | Lowry et al. | 292/DIG. 38 |

FOREIGN PATENT DOCUMENTS

| | | |
|---|---|---|
| 2443 | 10/1978 | European Pat. Off. . |
| 2029081 | 6/1970 | Fed. Rep. of Germany . |

*Primary Examiner*—Richard E. Moore

*Attorney, Agent, or Firm*—Holman & Stern

[57] ABSTRACT

A detachable latch for a container is arranged to snap fit into a latch pocket and operate with minimal or no frictional interference in releasing a projecting bolt member from a closure position wherein it projects through a slot in the container cover. In a first embodiment, the base of the latch member abuts the pocket wall and is restrained from upward displacement by a wing-slot engagement. A retainer blade projects forwardly from the upper half of the latch to a location above a retainer shelf of the container body to preclude downward displacement of the latch. At least one nub projects upwardly from the shelf to provide minimal contact with the underside of the blade if the blade is inadvertently lowered into contact with the shelf. To open the container, the latch is flexed about its base by pushing the upper part of the latch into the pocket, thereby removing the bolt at the top of the latch from the cover slot. In a second embodiment, the container has symmetrically opposed covers and is served by a single latch having independently flexible halves.

10 Claims, 10 Drawing Figures

FIG. 1
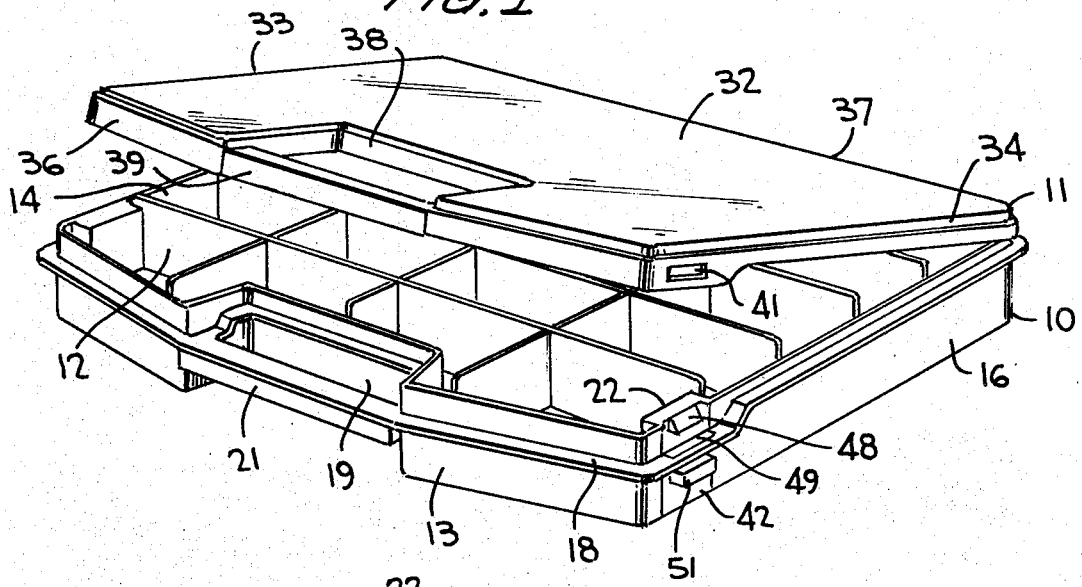
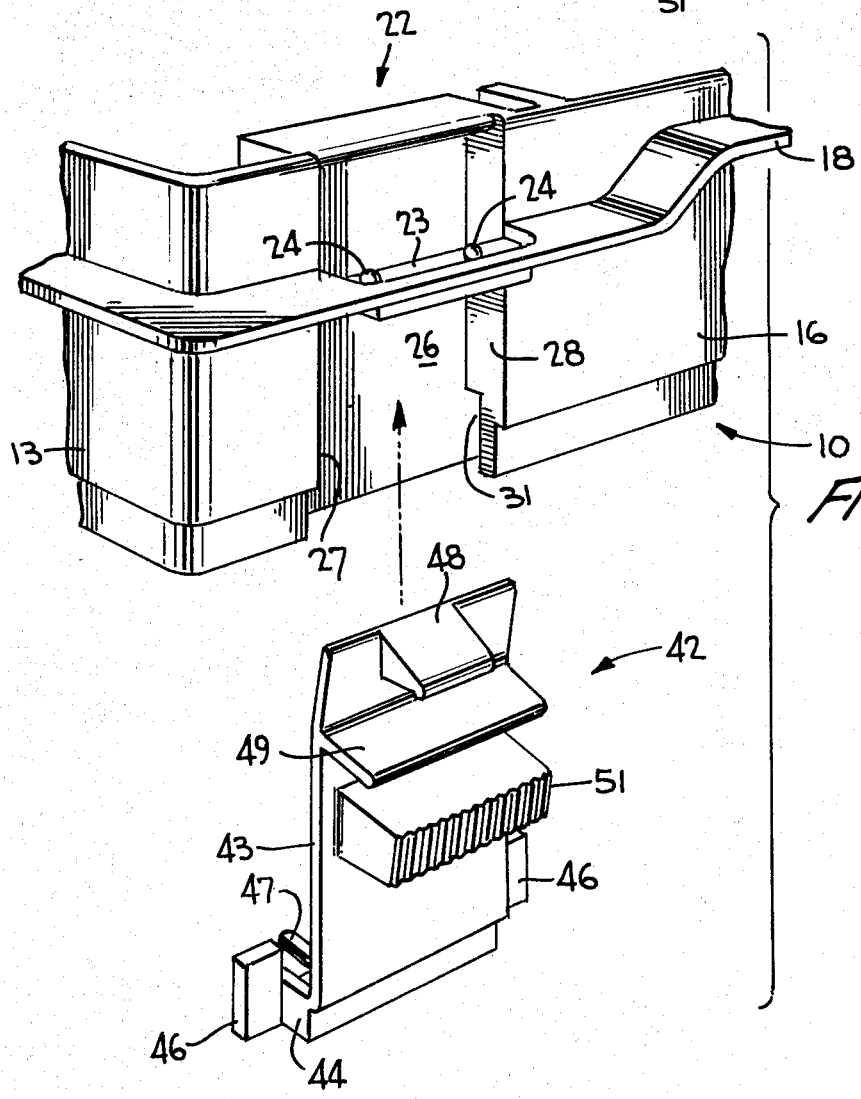
FIG. 2

61
62
63
64
66
67
68
69
70
71
72
73
74
75
76
77
78
79
81
82
83
84
86
87
90
91
92
94
96
97

DETACHABLE LATCH

TECHNICAL FIELD

The present invention relates to container closures in general and, more particularly, to closures of the type employing a latch member which snap-fits into engagement with the container.

BACKGROUND ART

Molded plastic containers, such as box-type containers having separately molded container and cover parts which are hinged together, are widely used. It has been recognized as desirable to provide a detachable latch member to effect closure between the cover and container in order to permit the latch to be replaced if it is damaged. In other words, if the latch arrangement is made as an integral part of the cover and/or container, damage to the latch requires replacement of the entire assembly; a detachable latch therefore greatly adds to the useful life of the container.

One prior art detachable latch is described in U.S. Pat. No. 3,730,576 to Schurman. This latch snap fits onto a container cover by means of an anchor bar on the cover which is laterally inserted into a slot on the latch. The anchor bar has enlarged working heads which fit through the latch slot such that the latch engages shank portions of reduced thickness behind the locking heads. During latching and unlatching operations severe stresses are placed on the reduced shank portions with the result that failure or rupture of the anchor bar occurs. Moreover, the latching mechanism itself relies on a locking tab snapping behind a latching shoulder. This snapping action, each time the container is opened and closed, provides a severe stress on the tab and shoulder, thereby resulting in a relatively short life for the latch. Importantly, since the latching shoulder is part of the container, rupture of the shoulder requires replacement of the entire container and thereby negates the intended advantage of providing a detachable latch. In addition, this tab-shoulder snapping arrangement renders it difficult to open the container quickly due to the fact that the snapping action is achieved with a relatively short tab; that is, the turning moment or torque applied to deform the tab in an opening operation is applied over the relatively short tab length so that little, if any, mechanical advantage is obtained. The required force to deform the tab and open the container is therefore relatively large.

Another prior art detachable latch is described in European Patent Office Publication 0002443 (Petit). In that publication, a latch is disclosed wherein the latch is detachably inserted into a slot in a container and projects upwardly from that slot to releasably engage a cover in a hook and notch engagement. Lateral clearance is provided in the slot so that the latch can be flexed to slide the hook away from the notch and release the cover for opening. This arrangement results in much less stress on the latch during opening and closing than is the case in the Schurman patent. However, the latch in Petit includes a projection which serves as the latch actuating mechanism and which resides in flush surface-to-surface or planar contact with the bottom edge of the cover. When the projection is pushed laterally to flex the latch and release the hook from the notch, friction between the flush surfaces of the latch projection and cover edge opposes lateral motion of the latch, thereby requiring a considerable applied force to effect opening of the container. Moreover, the hook and notch closure are slidably engaged and present frictional opposition to flexure of the latch during opening. Apart from adding to the required opening force, the friction between the hook and notch results in wear and tear of these two parts and leads to the premature failure of the latching mechanism.

It is therefore an object of the present invention to provide a detachable latch for a container-cover assembly which is easy to open and which is not subject to premature failure.

It is another object of the present invention to provide a detachable latch which fits a container in a manner such that frictional opposition to flexure of the latch member is minimized or non-existant.

It is still another object of the present invention to provide a detachable latch which, when operated, is not subject to stresses that may lead to failure.

Certain containers have covers on two sides; that is, the container body has two separate cover members hinged thereto on opposite sides. It is desirable to have a detachable latch which can independently latch both covers and which is devoid of the aforementioned disadvantages of prior art latches.

It is therefore an object of the present invention to provide a detachable latch which is capable of independently controlling two covers on opposite sides of a container and which is easy to operate and not subject to failure due to use.

DISCLOSURE OF THE INVENTION

In accordance with the present invention, a detachable latch includes a bolt arranged to engage a slot in the container cover. In a first embodiment, the latch is inserted into a latch pocket formed in the container and is prevented from moving longitudinally upward by retainer slots adjacent the pocket which engage transversely extending wings projecting from the bottom of the latch. Longitudinally downward movement is precluded by a container shelf which, when the latch is fully inserted, is disposed below a retainer blade which projects from the latch in a forward direction. The latch catch or bolt member projects forwardly from or near the latch top. The latch pocket is recessed in depth to a dimension greater than the upper latch thickness, and bias pins project rearwardly to the pocket wall from the rear of the latch bottom. A push button projects forwardly from the latch at a location below the retainer shelf and, when pushed into the pocket, causes the upper portion of the latch to flex in a pivot-like movement about the bias pin contact with the latch pocket wall. This brings the bolt member out of the plane of the cover slot so that the container can be opened. When the latch is fully inserted upwardly into the pocket until it is stopped by the engagement between the latch wings in the retainer slots, the bolt member extends through the cover slot without contacting the cover, and the retainer blade is spaced slightly above the container shelf; therefore, minimal or no frictional engagement opposes the flexure of the latch during opening. In the event that the latch is not fully inserted upward into the pocket, the shelf is provided with upwardly protruding nubs which are tangentially contacted by the bottom surface of the retainer blade, thereby providing point-to-surface rather surface-to-surface contact and thus limiting any frictional opposition to latch flexure.

In a second embodiment, a latch pocket is provided with a horizontally-extending divider wall located at the vertical mid-line of the pocket. A latch is arranged with rearward projections forming a channel adapted to receive the forward edge of the divider wall in snap-fit engagement. The latch is symmetrical about its vertical midline, each end including a push button and a bolt member and adapted to independently flex rearwardly into the latch pocket about the snap-fit engagement without affecting the other end of the latch. When so flexed, the bolt member moves out of the plane of a slot in the container cover to permit the cover to be opened. The bolt member is positioned on the latch so as to fit into the cover slot without contacting the cover.

BRIEF DESCRIPTION OF THE DRAWINGS

The foregoing and other objects, advantages and characterizing features of the present invention will become clearly apparent from the ensuing detailed description of illustrative embodiments thereof, taken together with the accompanying drawings wherein like reference numerals denote like parts in the different figures:

FIG. 1 is a view in perspective of a container employing the detachable latch arrangement according to one embodiment of the present invention;

FIG. 2 is an exploded detail view in perspective showing the latch and container latch pocket of the embodiment of FIG. 1;

DESCRIPTION OF THE PREFERRED EMBODIMENTS

Figure 3:
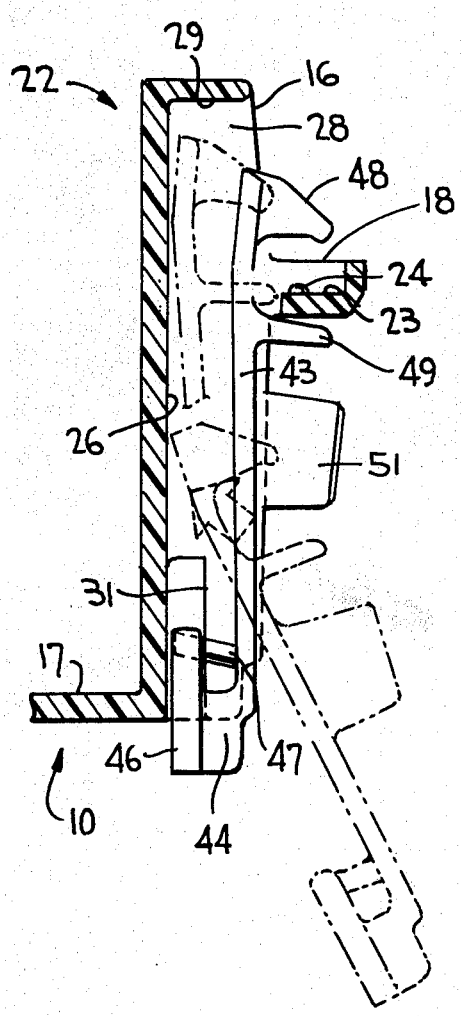
FIG. 3 is a partially diagrammatic view in section showing how the latch is inserted into the latch pocket in the FIG. 1 embodiment.

Referring more specifically to FIGS. 1 through 4, a first embodiment of the present invention includes a container body 10 and a cover 11 which is hinged (not shown) in a conventional manner to body 10 at the rear of the container. Container body 10 is preferably made of molded polypropylene; the cover lid is preferably a translucent acrylic material. The particular container illustrated in FIG. 1 also includes a plurality of insert member 12 which subdivides the the container interior into a grid-work of isolated compartments; this is not to be construed as a limiting feature of the present invention.

Container body 10 has a front wall 13, a rear wall (not shown), side walls 14, 16 and bottom wall 17 and is provided with a peripheral drain flange 18 which is formed integrally with body 10 and projects outwardly from the body on all four sides. The mid-portion of front wall 13 is recessed at 19, the forward end of the recess being bridged by a handle portion 21. There is defined in each side wall 14, 16 a latch pocket in the form of a recess 22 in each side wall. Recess 22 has a generally rectangular configuration and is open at its bottom to permit insertion of a latch member. Drain flange 18 extends across the open front of recess 22, where it is recessed downward to define a retainer shelf 23. A pair of generally semispherical nubs 24 project upwardly from shelf 23 to a height considerably below the un-recessed portion of drain flange 18. Recess 22 itself is defined by a rear wall 26, two side walls 27, 28 and a top wall 29. A pair of retainer slots 31 (only one visible in the drawings) are defined in side walls 27, 28 and extend longitudinally from the bottom of the latch pocket approximately one-quarter the way up the pocket height. The rear of slots 31 are defined flush with rear pocket wall 26 and have a front to back thickness which is less than the depth of the pocket or recess 22. The bottom of slots 31 is open.

Cover member 11 includes a top wall 32, side walls 33, 34, front wall 36 and rear wall 37. The open bottom of cover 11 is designed to fit over the open top of body 10 and the bottom edges of the cover front, rear and side walls are contoured to abut the drain flange 18 on body 10. Front wall 36 of the cover is recessed rearwardly at 38 to match recess 19 in body 10. A handle member 39 bridges the forward portion of recess 38 and, when the cover is closed, is positioned adjacent handle member 21 so that both handle members 21 and 39 serve as a handle for carrying the container when in a closed condition. Cover side walls 33 and 34 are each provided with a latch recess 41 disposed in alignment with the latch pocket recess 22 when the cover is closed.

Latching of the cover 11 in the closed position is effected by a latching member 42 that is detachably inserted into latch pocket recess 22 of body 10. Latching member 42 is made in one piece of a solid material capable of flexural bending; the preferred material is polypropylene. The latching member includes a plate 43 which is shorter lengthwise than the height of the latch pocket recess 22 and which depthwise is considerably smaller than the depth of recess 22. The width of plate 43 is just slightly less than that of recess 22 to permit the latch to slide into place in the latch pocket. Plate 43 is substantially flat throughout its length but includes an upper portion which tilts forwardly from the plane of the lower part of the plate at a small angle on the order of 8°. The upper portion constitutes approximately fifteen percent of the length of plate 43. The bottom of member 42 is in the form of a base portion 44 which is recessed slightly from the front surface of plate 43 and is considerably thicker that plate 43. Base portion 44 includes a pair of wings 46 extending transversely from the base portion and configured to be engaged by retention slots 31 in the latch pocket. Wings 46 are generally rectangular in section and extend lengthwise from the bottom of the latching member 43 to somewhat above the height of base portion 44. A pair of spacer pins 47 extend rearwardly from the back of plate 43 to a depth which terminates flush or co-planar with the rearward most parts of base portions 44 and wings 46. Spacer pins 44 extend at a small upward angle (on the order of 10°) relative to the bottom surface of base portion 44.

A bolt member 48 projects forwardly from the front surface of plate 43 at a location proximate the top of that plate. Bolt member 48 includes a bottom surface which is substantially horizontal (i.e., parallel to the bottom of surface of base portion 44) and a top surface which converges toward and meets the bottom surface at an angle of approximately 45° to form a wedge-like structure. If desired, the forward edge of bolt member 48 may have its bottom surface bent slightly downward, as shown to form a lip which serves to preclude inadvertent opening of the latch.

A retainer blade 49 projects forwardly of latch plate 43 at a location below and spaced from bolt member 48. Retainer blade 49 extends across substantially the entire width of plate 43 and is positioned to reside within the recess forming retention shelf 23 in drain flange 18. Retainer blade 49 is thus intended to preclude downward movement of latch 42 within the latch pocket.

A push buttom 51, having a serrated front surface, also projects forwardly of plate 43 from a location below retainer blade 49. If the portion 44 of latch member 42 is fixed against a rear support, pushing push button 51 inward causes flexure of plate 43 about pins 47 to permit pivoting of bolt member 48 into the latch pocket.

Insertion of latch member 42 into the latch pocket is illustrated in FIG. 3. In position A shown in phantom lines, the back edge of the top of the latch member is shown sliding up along the rear wall 26 of latch pocket recess 22. As the bolt member 48 passes behind retention plate 23, the bottom of the latch member is pivoted rearward to permit wings 46 to slide into retainer slots 31. The latch is then pushed further upon into the pocket until the top surface of retainer blade 49 abuts the bottom of retention shelf 23. This position is shown in solid lines in FIG. 3. In order to firmly engage the latch into the pocket, the push button 51 is pushed into the pocket while pushing up on the latch so that as the retainer blade 49 clears shelf 23 (position C, in phantom, FIG. 3) the latch can be inserted fully into the pocket. Push button 51 is released once the retainer blade clears the retainer shelf and the inserted latch take the position shown in solid lines in FIG. 4.

From the foregoing, it will appreciated that the spacing (depthwise) between retention shelf 23 and rear wall 26 of recess 22 must be sufficient to permit clearance for bolt member 48 and then retainer blade 49 when the plate 43 is flexed during insertion. Other important dimensional relationships relate to the vertical positioning of bolt member 48 and retainer blade 49 once the latch is fully inserted. Specifically, the distance between the uppermost part of slot 31 and top wall 29 is slightly greater than the distance between the top of wing 46 and the uppermost part of latch 42; this permits full upward insertion of the latch into the pocket without contact between the top of the latch and top wall 29 of the latch pocket recess. Further, the vertical distance between the top of wings 46 and the underside of retainer blade 49 is slightly greater than the distance between the top of slots 31 and the top of nubs 24, but not so great as to permit a portion of wings 46 to extend below the bottom of slots 31 when the underside of blade 49 rests on nubs 24; this permits the retainer blade 49 to be free from frictional engagement with shelf 23 during a latch opening operation when the latch is fully inserted and to limit such frictional engagement to point contact with the nubs if the latch is not inserted upward to the fullest extent. Slot 41 is chosen sufficiently large to accept bolt member 48 projecting therethrough without contacting the walls of the slot; further, slot 41 is vertically positioned, when cover 11 is closed, to provide non-contact clearance between bolt member 48 and slot 41 when the latch is inserted in the pocket. Push button 51 is located as to not contact shelf 23 when the latch is inserted into the latch pocket.

Figure 4:
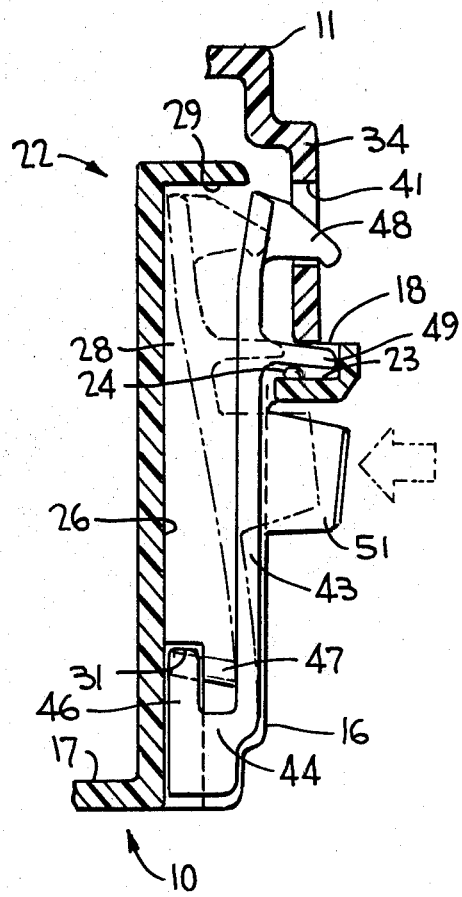
FIG. 4 is a view in section showing the latch of FIG. 1 in latched condition and also showing, in phantom lines, the open condition.
Figures 5, 6:
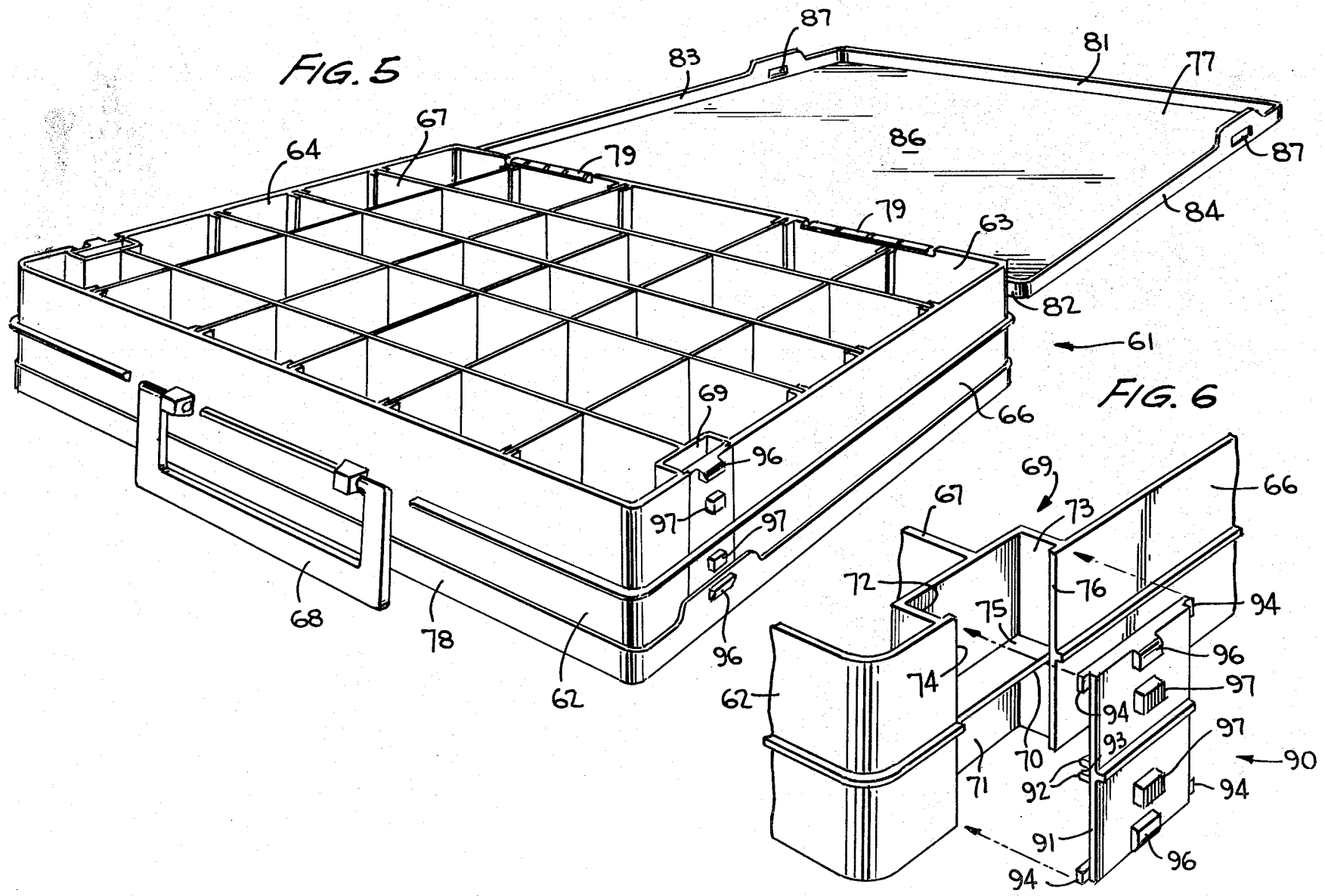
FIG. 5 is a view in perspective of a container having two covers and employing the detachable latch arrangement according to a second embodiment of the present invention.
FIG. 6 is an exploded view in perspective showing the latch and latch pocket of FIG. 5.

When the latch is inserted in the pocket, as shown in FIG. 4, it assumes an unstressed position wherein bolt member 48 projects well out of the latch pocket recess 22 and through slot 41 when cover 11 is closed. To open the container, push button 51 is pushed into the slot causing plate 43 to flex about pins 47 and into the recess 22 to the position shown in phantom in FIG. 4. There is sufficient depth in the top of recess 22 to permit bolt member 48 to clear the plane of slot 41 so that the cover 11 may be lifted open. When push button 51 is released, the latch member returns to its unstressed position shown in solid lines in FIG. 4. Cover 11 can be closed without actuating push button 51 by pushing the cover down so that the bottom edge of the cover acts on the stoped top of bolt member 48 in the manner of a cam to flex the latch member into the recess 22 as the cover is closed; when the cover is fully closed the latch member returns to its unstressed position because bolt member 48 is aligned with slot 41.

It is important to note that, when the latch member 43 is properly inserted in recess 22, an opening operation proceeds with no frictional opposition to the applied force. This is because of the clearance provided between retainer blade 49 and shelf 23 and between bolt member 48 and slot 41. Since downward movement of the latch 42 in the latch pocket is limited by contact between the underside of blade 49 with nubs 24, the only possible frictional opposition to an applied opening force, even for an improper latch insertion, is along this limited two-point contact. Prior art latches, as noted above, have surface-to-surface or edge-to-surface frictional engagement. Moreover, the minimal flexure required of the latch member assures reliable long-term operation without rupture due to normal use.

Another embodiment of the present invention is illustrated in FIGS. 5 through 10 to which specific reference is now made. A container body 61 includes front wall 62, rear wall 63 and side walls 64, 66. Container body 61 is open at its top and bottom. Body 61 is preferably molded polypropylene material or the like. The interior of body 61 may be sub-divided by means of partition member 67 into plural compartments. A handle 68 is recessed to the front wall 62 to permit the container to be readily carried.

A latch pocket in the form of a recess 69 is defined in each of side walls 64, 66. Recess 69 is configured as a vertically extending channel, open at both ends, subsisting over the entire height of the sidewalls 66, 64, and includes a rear wall 71 and side walls 72, 73. The container side wall 66 overhangs recess 69 on both sides to form two opposed lips 74, 76 at the latch pocket entrance; that is, the lips 74, 76 are spaced by a slightly shorter distance than the spacing between side walls 72, 73. The recess 69 is sub-divided into two identical compartments by a horizontally-disposed divider wall 75, the forward edge of which is recessed slightly so as not to project between lips 74, 76.

This embodiment is provided with substantially identical covers 77, 78 for the top and bottom, respectively, of container body 61. The covers are hinged to the edge of rear wall 63 as shown at 79. Covers 77, 78 are preferably made of a transparent acrylic material. Each of the covers includes a front wall 81, rear wall 82 and side walls 83, 84 which depend peripherally from a main wall 86. These walls are spaced to permit the covers to fit over the respective ends of body 61 with the front, rear and side walls vertically extending partially along corresponding walls of container 61. A slot 87 is defined in each of cover side walls 83, 87 in the portion of those side walls which overlie the latch pockets 61 when the covers are closed.

A dual detachable latch member 90 comprises a thin rectangular plate 91 made of polypropylene or the like, the height of plate 91 corresponding to the height of body 61 and the width of the plate corresponding to slightly less than the spacing between lips 74, 76 in latch pocket 69. The thickness of plate 91 is substantially the same as the thickness or depth of lips 74, 76. A pair of spaced guide members 92 extend longitudinally across the entire width of the back side of plate 91 to define a retention channel 93 therebetween. The spacing between members 92 and hence the height of the channel 93 is such as to permit the forward edge 70 of latch pocket divider wall 75 to be engaged in channel 93 in a snap-fit. Further guide members 94 extend horizontally across the top and bottom of the back side of plate 91. Guide members 94 extend beyond the width of plate 91 to an extent slightly smaller than the corresponding width dimension of lips 74, 76.

The front of plate 91 includes bolt members 96 projecting forwardly from locations at the top and bottom of the plate. Bolt members 96 are sized to fit through slots 87 in the covers without interference and are positioned so as to project through these slots when the covers are closed. Push buttons 97 also project from the front of plate 91, one from each vertical half of the plate.

Figure 7:
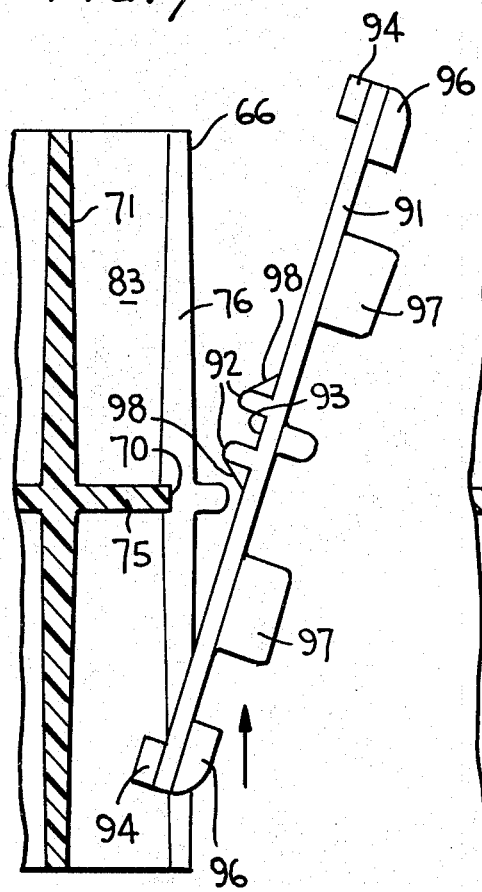
FIGS. 7 and 8 are views in section illustrating how the latch of FIG. 5 is inserted into the latch pocket.
Figure 8:
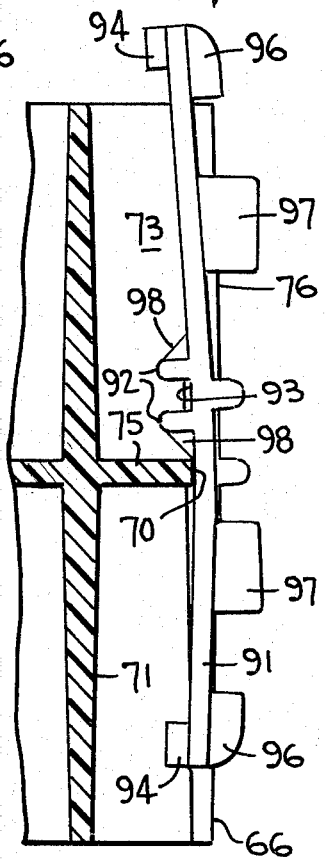

Latch member 90 may be inserted into latch pocket recess 69 in the manner shown in FIGS. 7 and 8. Initially, the latch 90 is tilted relative to recess 69 with its top forward (or its bottom forward if it is desired to insert the latch bottom first). The bottom guide member 94 is then brought up into recess 69 as shown in FIG. 7. The latch member is moved upward until both members 92 are above and beyond divider 75, whereupon the top of the latch member is rotated back toward the recess, the bottom of the latch member being constrained in the recess by lips 74, 76 acting on bottom guide member 94. Upon continued rotation of the latch member, the forward edge 70 of divider 75 abuts the back side of plate 91 at a location below the members 92. The constraints at bottom guide member 94 and edge 70, as seen in FIG. 8, result in flexure of the plate 91 upon continued rotation of the latch. This permits the upper guide member 94 to be pushed behind the plane of lips 74, 76 from which position the latch 90 is pushed down until the upper and lower guide members 94 are both inside recess 69 and constrained by lips 74, 76. This downward push, which might otherwise be impeded by divider 75 blocking lower member 92, is facilitated by a sloped guide member 98 which rides along edge 70 of the guide member during insertion. When channel 93 is disposed opposite divider edge 70, the middle of the latch is pushed firmly into the recess 69 so that edge 70 is forced into channel 93 in a snap-fit.

Figure 9:
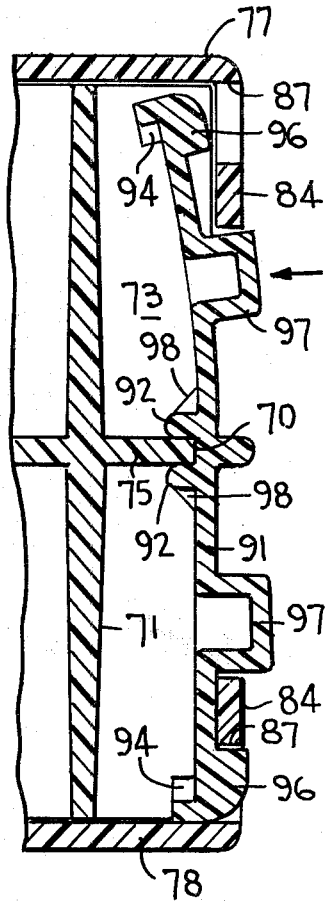
FIG. 9 is a view in section showing the operation of the latch of FIG. 5.
Figure 10:
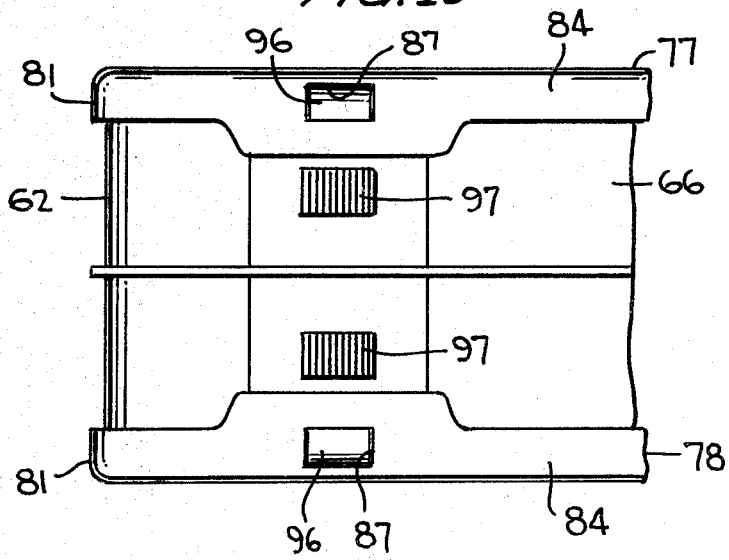
FIG. 10 is a plan view of a portion of the container of FIG. 5 showing the container with both covers latched closed.

Operation of latch 90 is illustrated in FIG. 9 wherein the top half of the latch is shown open and the bottom half is shown closed. Each half flexibly pivots independent of the other about the snap-fit engagement in channel 93 when the appropriate push button is pressed in. Such pivoting moves the bolt member 96 out of the plane of cover slot 87 without frictional opposition from any part of the latch.

It is thought that the invention and many of its attendant advantages will be understood from the foregoing description, and it will be apparent that various changes may be made in the invention without departing from the spirit and scope of the invention or sacrificing its material advantages, the forms hereinbefore described being merely the preferred embodiments thereof.

The embodiments of the invention in which an exclusive property or privilege is claimed are defined as follows:

1. A closure for a container, comprising:

a container body having a peripheral wall with an external surface and with a latch pocket defined as a recess in said external surface;

a cover member for said container having a slot defined therein, said slot being positioned to overlie said latch pocket when said container member is closed by said cover member; and an integral detachable flexible latch member attached to said container body in said latch pocket with a snap-fit, said latch member having a bolt member projecting in a first direction from a first surface of said latch member to extend through said cover slot without contacting said cover member when the latch member is attached into said latch pocket and is unflexed and when said container member is closed by said cover, said latch member further including actuating means on said first surface for receiving a force directed to flex said latch member in a direction opposite to said first direction to withdraw said bolt member from said slot.

2. The combination according to claim 1 further comprising:

a retainer shelf on said container body extending across a portion of said latch pocket recess; and a retainer blade projecting in said first direction from said first surface;

said retainer shelf and retainer blade being positioned such that, when said latch member is snap-fitted into said latch pocket, said shelf and said blade interact to limit sliding movement of said latch member in a first sense in said latch pocket.

3. The combination according to claim 2 further comprising retainer means for limiting sliding movement of said latch in said latch pocket in a second sense opposite said first sense.

4. The combination according to claim 3 wherein said retainer blade and said retainer shelf are slightly spaced from one another when said latch member is slid in said latch pocket in said second sense to the limit permitted by said retainer means.

5. The combination according to claims 2, 3 or 4 further comprising at least one small nub projecting from said retainer shelf towards said retainer blade when said latch member is attached to said latch pocket.

6. The combination according to claims 3 or 4 wherein said retainer means comprises:

at least one retainer projection extending from said latch member; and a retainer slot defined in said latch member for receiving said retainer projection;

wherein said retainer slot includes a stop wall at one end thereof corresponding to the extremity of said slot in a dimension corresponding to said second sense, and wherein said retainer projection includes a surface which abuts said stop wall to limit sliding of said latch in said second sense.

7. The combination according to claim 1 wherein:

said latch member includes two halves symmetrically disposed about a transverse center line of said latch member, each latch half including one of said bolt members and one of said actuating means;

wherein said container body includes a divider wall extending transversely across said latch pocket to divide said latch pocket into symmetrical halves, said divider wall having a transversely extending forward end;

wherein said latch member includes channel means on a second surface opposite said first surface for snap-fitting onto said forward edge of said divider wall; and wherein the depth of said latch pocket is sufficiently great in the region of said bolt members to permit withdrawal of each bolt member independently into said latch pocket by flexing the corresponding latch member half.

8. The combination according to claim 7 further comprising a pair of retainer lips projecting inward from the sides of said latch pocket over the front portion thereof; and a pair of retainer wings extending from each side of said latch member at opposite ends thereof for engaging the retainer lips and thereby retain the end portions of said latch member in said latch pocket.

9. A container closure arrangement of the type comprising a container body, at least one cover mating with said body, and detachable latch members formed of flexible thermo-plastic in one-piece unitary construction, said arrangement being characterized by:

at least one latch pocket defined in said container body, said pocket comprising at least one open end, and a relatively large depth dimension terminated by a rear pocket wall;

a cover slot defined in said cover overlying said latch pocket;

said latch member being configured to fit into said latch pocket through said open end when said latch member is flexed, said latch member having a relatively small depth dimension defined between front and rear surfaces;

means for engaging said latch member in said latch pocket comprising:

a retainer blade projecting from said front latch surface and a retainer shelf formed as part of said container body extending across at least a portion of the front of the latch pocket, said blade and said shelf being positioned opposite one another when said latch member is fitted into said latch pocket to limit movement of said latch member toward said open end of said latch pocket;

mutually abutting means in said container body and said latch member for defining a limited position of said latch member in said latch pocket away from said open latch pocket end;

a bolt member projecting from said front surface of said latch member to pass through said cover slot without touching said cover when said latch member is unflexed and in said limited position in said latch pocket;

wherein said retainer blade is spaced from said retainer shelf when said latch member is in said limited position;

means projecting from the rear surface of said latch member to contact a location on said rear wall of said latch pocket when said latch member is inserted into said latch pocket;

wherein said latch member is contoured to have its rear surface spaced from the rear latch pocket wall when the latch member is unflexed and wherein the depth of said latch pocket is sufficiently greater than the latch member depth to permit the rear latch member surface opposite said bolt member to be flexed about said contact location and into the latch pocket sufficiently to permit said bolt member to be fully withdrawn from said cover slot.

10. A container closure arrangement of the type comprising a container body, at least one cover mating with said body, and a detachable latch member formed of flexible plastic material in one-piece unitary construction, said arrangement being characterized by a latch pocket defined in said container body into which said latch member snap-fits, a slot defined in said cover member overlying said latch pocket, a bolt member projecting from said latch member through said cover slot without contacting said cover member, and wherein said latch member is flexible to withdraw said bolt member from said cover slot by pivoting into said latch pocket without frictional engagement with said cover and container body.

* * * * *